US006446315B2

(12) United States Patent
Agee et al.

(10) Patent No.: US 6,446,315 B2
(45) Date of Patent: Sep. 10, 2002

(54) DISH ASSEMBLY FOR A BURIAL CASKET CAP

(75) Inventors: David L. Agee, Batesville; Rosalie J. Calhoun, Osgood; Richard A. Colangelo, Indianapolis; Donna F. Gould, Batesville; Brian K. Groemminger, Batesville; Bryan M. Hankel, Batesville, all of IN (US); Donald R. Maier, Cincinnati, OH (US); Donald D. Maple; William F. Neth, both of Batesville, IN (US); Ilija Rojdev, Fairfield, OH (US); Scott A. Schultz, Batesville, IN (US)

(73) Assignee: Batesville Services, Inc., Batesville, IN (US)

( * ) Notice: Subject to any disclaimer, the term of this patent is extended or adjusted under 35 U.S.C. 154(b) by 0 days.

(21) Appl. No.: 09/822,373

(22) Filed: Mar. 30, 2001

Related U.S. Application Data

(62) Division of application No. 09/165,990, filed on Oct. 2, 1998, now Pat. No. 6,237,202.

(51) Int. Cl.[7] ..... A61G 17/00
(52) U.S. Cl. ..... 27/14; 27/19; 40/725
(58) Field of Search ..... 27/19, 14, 2, 1; 40/725, 727

(56) References Cited

U.S. PATENT DOCUMENTS

| | | | |
|---|---|---|---|
| 1,192,169 | A | 7/1916 | DeCamp |
| 1,669,895 | A | 5/1928 | Blyth |
| 2,556,283 | A | 6/1951 | Lieberman |
| 2,664,615 | A | 1/1954 | Hillenbrand et al. |
| 2,735,205 | A | 2/1956 | Knox |
| 2,867,030 | A | 1/1959 | Hillenbrand |
| 2,947,059 | A | 8/1960 | Hillenbrand |
| 2,964,824 | A | 12/1960 | Hillenbrand |
| 3,157,936 | A | 11/1964 | Hillenbrand |
| 3,408,759 | A | 11/1968 | Rotheraine et al. |
| 3,540,146 | A | 11/1970 | Watkins |
| 3,810,281 | A | 5/1974 | Ferber |
| 4,357,741 | A | 11/1982 | Winburn et al. |
| 4,457,054 | A | 7/1984 | Craft et al. |
| 5,007,148 | A | 4/1991 | Bida |
| 5,495,648 | A | 3/1996 | Rojdev et al. |
| 5,632,073 | A | 5/1997 | Foye |
| 5,634,247 | A | 6/1997 | Bowling |
| 5,636,419 | A | 6/1997 | Foye |
| 5,675,877 | A | 10/1997 | Lewis |
| 5,813,099 | A | 9/1998 | Stewart |

*Primary Examiner*—J. J. Swann
*Assistant Examiner*—William L. Miller
(74) *Attorney, Agent, or Firm*—Wood, Herron & Evans, L.L.P.

(57) ABSTRACT

In an effort at increasing the quality and styling of the casket interior, and in particular the casket cap dish assembly, and in an effort to increase the quality of the memorialization aspect of the casket and memorial service, the present assembly was devised which comprises, in one aspect, a dish assembly for installation into an underside of a casket cap, the assembly comprising a foam dish including an opening therethrough, and a cap panel installed in the opening in the foam dish. In a second aspect, the dish assembly comprises a dish including an opening therethrough and a cap panel removably installed in the opening in the dish, the cap panel being personalized to the deceased and being removable from the dish by a loved one of the deceased subsequent to a memorial service for the deceased and retained by the loved one as a memorial to the deceased.

5 Claims, 3 Drawing Sheets

DISH ASSEMBLY FOR A BURIAL CASKET CAP

This application is a divisional application of Ser. No. 09/165,990, filed Oct. 2, 1998, now U.S. Pat. No. 6,237,202.

FIELD OF THE INVENTION

This invention relates generally to caskets, and more particularly to the interior decorative trim for caskets.

BACKGROUND OF THE INVENTION

Burial caskets traditionally comprise a shell to which is pivoted a cap or lid. During viewing of the deceased in the casket, the cap is, of course, pivoted to its open position to permit relatives, loved ones, acquaintances and the like to view the deceased. During this time the underside of the cap is visible. It is thus desirable to trim the underside of the cap with decorative trim. This has traditionally been accomplished with the installation of a so-called dish assembly into the underside of the cap.

The traditional dish assembly has taken the form of a rectangular cap panel having two long sides and two short sides, with a puffing board or panel or member being attached to each of the four sides with staples. The puffing boards, typically fabricated of a relatively stiff yet flexible substrate, such as chip board, are covered with decorative fabric. The cap panel is positioned in the casket cap atop a stand-off, itself positioned in the cap, or atop a ridge or groove forming a part of the cap. The free edges of the puffing members are retained in a peripheral groove in the casket cap near the peripheral edge of the cap. The puffing members are so sized as to require them to assume a convex, quarter-round shape with their free edges retained in the peripheral groove. A rectangular cap panel insert, including decorative embroidery or the like, may be removably installed between the four puffing members and in juxtaposition relative to the cap panel. The cap panel insert may be retained by the four puffing members by friction; alternatively, various means may be provided to secure the cap panel insert into the dish assembly, for example, hook and loop-type fasteners.

Mitered corners are formed at adjacent ends of the puffing members. The mitered corners may either be formed by simply overlapping the adjacent puffing member ends or by stapling the adjacent ends together. One example of overlapped, mitered corners is disclosed in U.S. Pat. No. 3,316,608, whereas one example of staple, mitered corners is disclosed in U.S. Pat. No. 2,964,824. A third technique involving folding one puffing member end, overlapping the puffing member ends and stapling the puffing member ends is disclosed in U.S. Pat. No. 5,634,247. All three of these patents are hereby incorporated by reference herein as if fully set forth in their entirety.

It is desirable to continue efforts and make further progress in the areas of simplifying fabrication, reducing manufacturing costs, and increasing the aesthetic qualities of casket interiors, and in particular dish assemblies for casket caps.

Burial caskets customarily include a locking mechanism on the casket shell, that, when actuated after closing the cap on the shell, holds the cap firmly and securely against the shell. In a funeral home, at the conclusion of a visitation, is it customary for the funeral director to close and lock the casket lid with a locking crank which includes a locking mechanism actuating key thereon. The casket lid may be locked closed for a specified number of years for public health reasons, which also gives comfort and solace to the family and loved ones of the deceased. Once the casket is locked, a common industry practice is for the funeral director to present the casket locking crank, normally ornate in appearance, to the deceased's family or loved ones as a memorial or keepsake of the service and the deceased.

It is desirable to continue efforts and make further progress in the area of memorialization of the deceased, and in particular increasing the quality of the memorial service for the loved ones as well as providing products and services that aid in the memorialization process.

SUMMARY OF THE INVENTION

In an effort at increasing the quality and styling of the casket interior, and in particular the casket cap dish assembly, and in an effort to increase the quality of the memorialization aspect of the casket and memorial service, the present invention was devised. In one broad aspect, the invention comprises a dish assembly for installation into an underside of a casket cap, the assembly comprising a foam dish including an opening therethrough, and a cap panel installed in the opening in the foam dish.

In a second broad aspect, the dish assembly comprises a dish including an opening therethrough and a cap panel removably installed in the opening in the dish, the cap panel being personalized to the deceased and being removable from the dish by a loved one of the deceased subsequent to a memorial service for the deceased and retained by the loved one as a memorial to the deceased.

The preferred embodiment of the present invention provides various additional advantageous features. For example, the assembly includes a dish box into which the foam dish is mounted. A backer panel is mounted on a rear side of the dish box. The dish box includes an opening therein corresponding to the opening in the foam dish. The backer panel is fabric covered such that when the cap panel is removed from the foam dish the fabric covered backer panel is visible through the foam dish opening and the dish box opening.

The cap panel is mounted in a frame. The cap panel and frame are removably installable in the foam dish opening as a unit. The cap panel further includes a decorative ornament mounted thereon. The cap panel, foam dish opening and dish box opening are oval shaped. The foam dish and cap panel are fabric covered. In cross-section, the foam dish is generally in the shape of a quarter-round. More particularly, the foam dish is constructed of first and second foam portions. The first foam portion in cross-section is in the shape of a beveled rectangle, and the second foam portion in cross-section is in the shape of a quarter-round. The first and second foam portions are adhered together. In addition, the foam dish and dish box are adhered together, and the backer panel and dish box are adhered together.

The cap panel includes structure facilitating display of the cap panel by the loved one of the deceased. The structure comprises a pair of legs on the rear side of the cap panel. The pair of legs are integrally formed from a paperboard backing of the cap panel. The pair of legs are die cut in the paperboard backing and are foldable rearwardly away from the balance of the paperboard backing. The first frame is mounted around the opening of the dish. The cap panel is mounted within a second frame. The cap panel and second frame are removably installable in the first frame of the dish opening as a unit. The dish may be either a foam dish of the type described above or a paperboard dish including a rectangular central panel having opposed side edges and opposed end edges and a puffing member at each of the edges of the central panel, with adjacent ends of adjacent ones of the puffing members forming a mitered corner.

In the preferred construction, the first and second frames include structure for removably securing them together. The structure comprises spring-loaded ball catches. The cap panel comprises a frame including a recess on a rear side thereof, a memory plaque/board positioned in the recess, a cardboard filler panel juxtaposed against the memory plaque/board, and an easel juxtaposed against the cardboard filler panel. The easel includes a pair of legs die cut therein and foldable rearwardly away from the balance of the easel for supporting the cap panel in an upright position. The memory plaque/board, cardboard filler panel and easel are retained in the recess of the frame with clips secured to the rear side of the frame. The first frame is secured to the dish with staples. The second frame is fabricated of urethane foam.

The invention thus provides an attractively styled dish assembly design while at the same time providing a memento from the memorial service in general and the casket in particular for the loved ones of the deceased.

These and other advantages of the present invention will become more readily apparent during the following detailed description taken in conjunction with the drawings herein, in which:

DETAILED DESCRIPTION OF THE INVENTION

Figure 1:
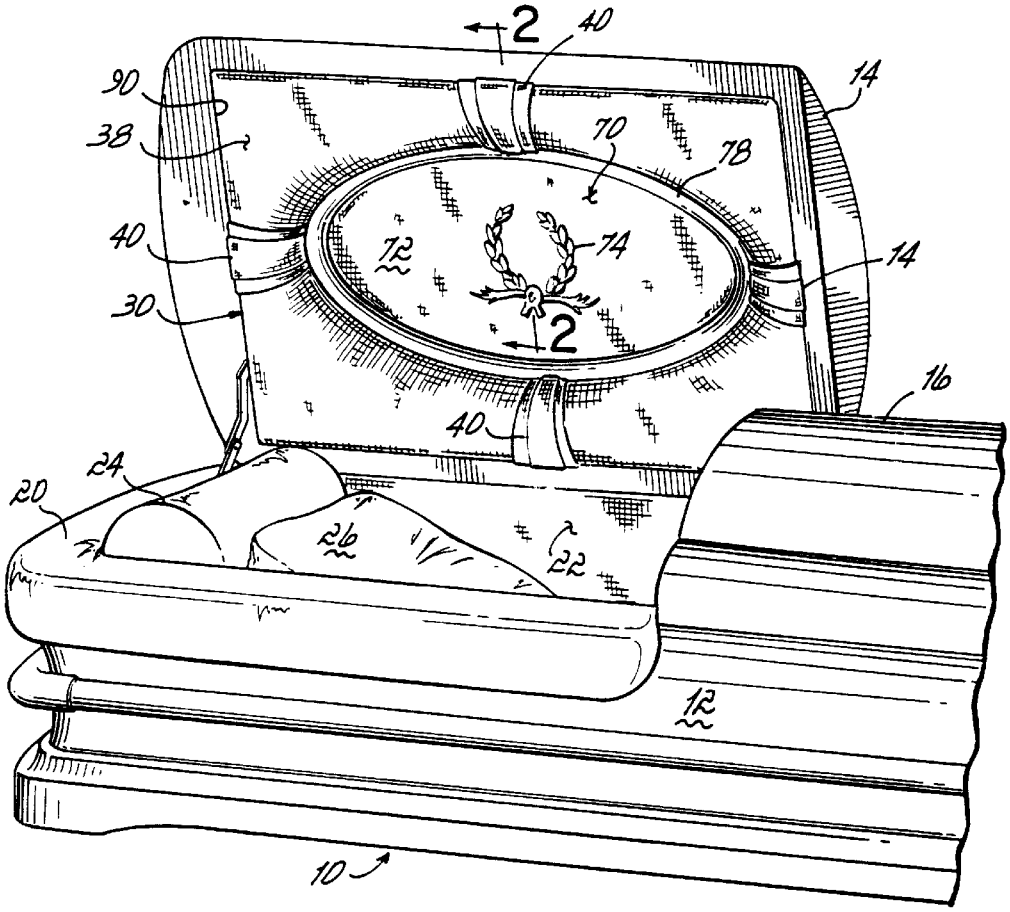
FIG. 1 is a perspective view of a head end portion of a casket with the head end cap in the open position revealing the dish assembly of the present invention.

Referring first to FIG. 1, there is illustrated a casket 10 according to the present invention. The casket 10 includes a lower body or shell 12 and head end 14 and foot end 16 caps pivoted thereto.

The shell 12 is trimmed out with a big body 20, small body 22 and pillows 24, 26. Head end cap 14 includes a decorative dish assembly 30 mounted therein and described in more detail below.

Figure 2:
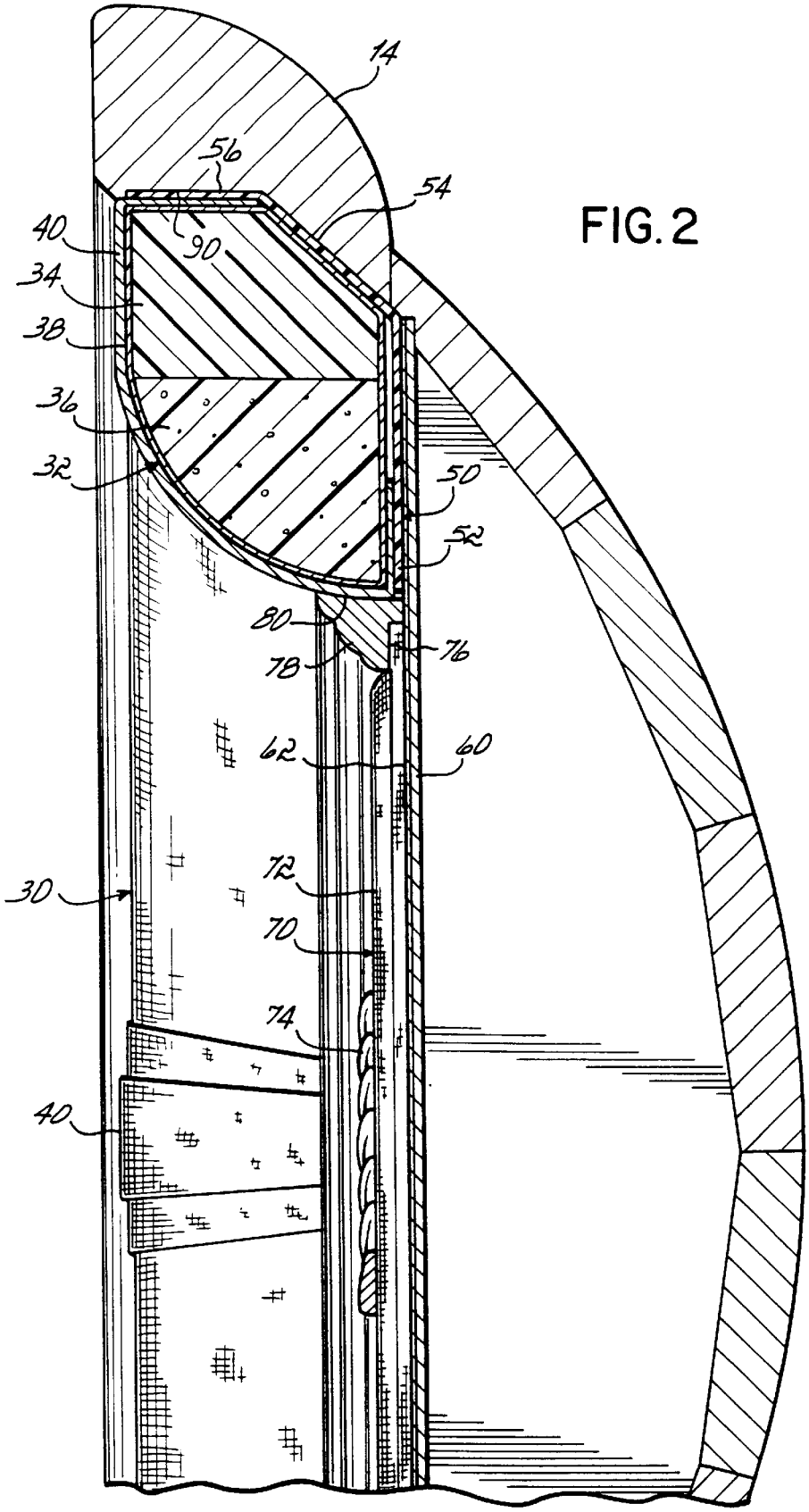
FIG. 2 is a cross-sectional view taken along line 2—2 of FIG. 1.

Referring now to FIGS. 1 and 2, dish assembly 30 includes a foam dish 32. The foam dish 32 is constructed of a first foam portion 34 and a second foam portion 36. The first foam portion 34 is, in cross-section, generally in the shape of a beveled rectangle. The second foam portion 36 is, in cross-section, generally in the shape of a quarter-round. Foam portion 34 is preferably S85 white polyurethane foam, whereas foam portion 36 is preferably 1745 white polyurethane foam. Foam portions 34 and 36 are adhesively secured together and covered with four separate pieces of decorative fabric 38 to obtain a smooth contour over the foam portions 34 and 36. Additional decorative pleats or tufting 40 is positioned at twelve o'clock, three o'clock, six o'clock and nine o'clock around the foam dish 32 and over the whip stitching (not shown) attaching the four pieces of fabric 38 together.

The foam dish 32 is mounted into a dish box 50. Dish box 50 includes a back panel portion 52, an angled wall portion 54 which matches the beveled rectangle shape of the foam portion 34, and a perpendicular wall portion 56. The foam dish 32 is preferably adhesively secured to the dish box 50.

A backer panel 60 is mounted on a rear side of the dish box 50. The backer panel 60 includes decorative fabric or the like 62 thereon. The backer panel 60 is adhesively secured to the dish box 50. The cap panel 70, similarly covered with decorative fabric 72, may have a decorative ornament 74 secured thereto. Cap panel 70 fits into a recess 76 in the rear side of a decorative frame 78, for example a mahogany wood frame. The frame 78 is sized so as to be a removable friction fit within the opening 80 defined by the foam dish 32. Thus, the cap panel 70 is removably installable in the dish assembly 30. It will be appreciated that if the cap panel 70 is removed from the dish assembly 30, the decorative fabric 62 covering the backer panel 60 is viewable through the oval shaped opening 80 in the foam dish 32 (and through a similar oval shaped opening formed in the dish box 50). The dish box 50, backer panel 60, and cap panel 70 are preferably fabricated of semi-rigid paperboard, for example 275 lb. "C" flute corrugated (bleached white). The rear side of backer panel 60 may include hook and loop-type fasteners (not shown) to aid in securing the dish assembly 30 in the cap 14. In that case, first portions of the hook and loop-type fasteners would be secured to the rear side of the backer panel 50 and second portions of the hook and loop-type fasteners would be secured within the cap 14 such that the first and second portions of the hook and loop-type fasteners come into contact when the dish assembly 30 is installed into the cap 14. Alternatively or in addition, the foam dish 32 is preferably sized such that it is a friction fit within the opening 90 in the cap 14.

Figure 3:
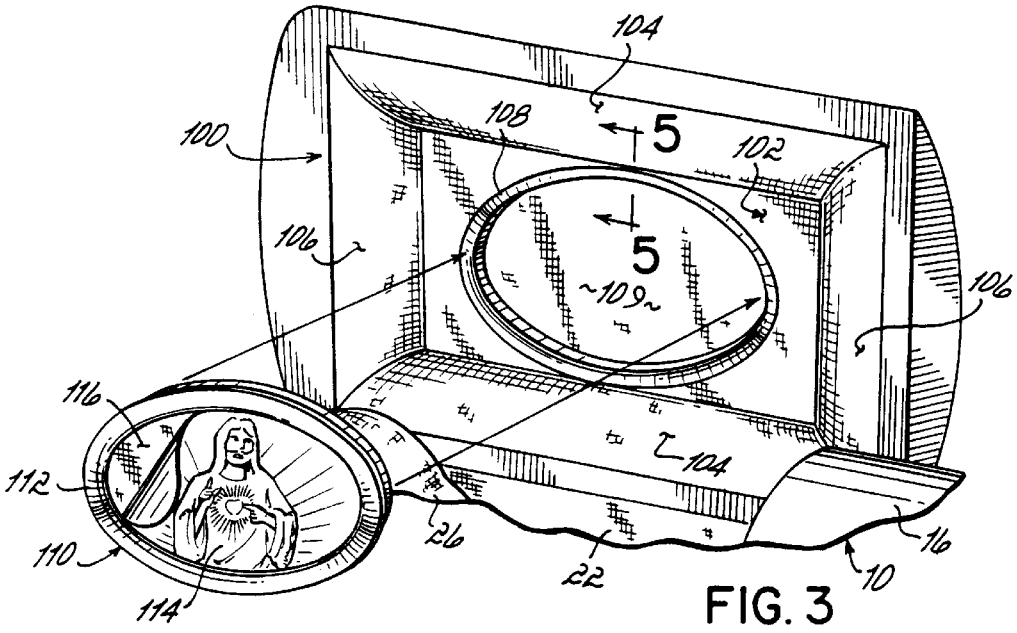
FIG. 3 is an alternative embodiment of the invention of FIGS. 1 and 2.
Figure 4:
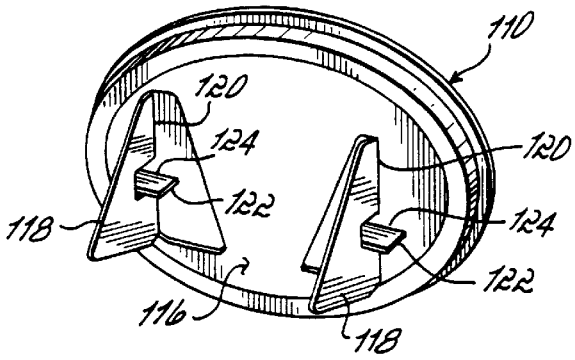
FIG. 4 is a rear perspective view of the removable cap panel of FIG. 3.
Figure 5:
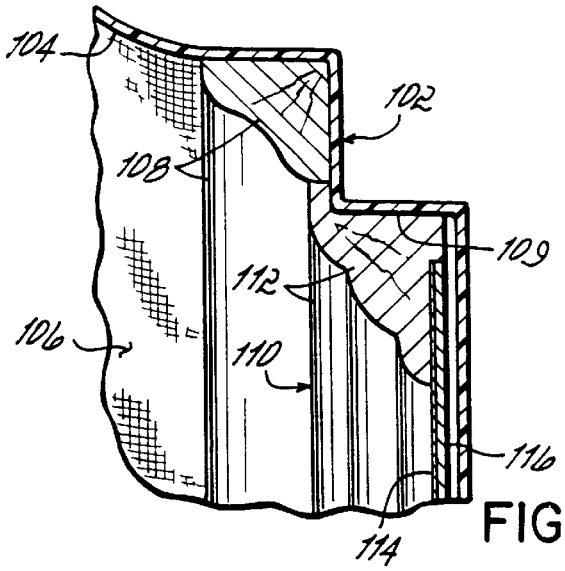
FIG. 5 is a cross-sectional view taken along line 5—5 of FIG. 3.

Referring now to FIGS. 3 through 5, there is illustrated an alternative embodiment of the dish assembly 100. In the embodiment 100, the dish assembly is not fabricated of foam but is fabricated of the semi-rigid paperboard referred to above and includes a rectangular panel 102, opposed long puffing members 104 and opposed short puffing members 106. A decorative frame 108 is mounted around an opening 109 in the panel 102. The decorative frame 108 removably receives a cap panel 110 including a decorative frame 112 and ornamentation 114. Ornamentation 114 may be of several forms, and preferably is personalized to the deceased such that the cap panel 110 can be removed from the dish 100 by a loved one of the deceased subsequent to a memorial service and then retained by that loved one as a memorial to the deceased or keepsake.

Referring to FIGS. 4 and 5, the cap panel 110 includes a semi-rigid paperboard backing 116 including die cut fold-out legs 118 which fold rearwardly away from the balance of the cap panel 110 along fold lines 120. Locking tabs 122, likewise die cut in the paperboard 116, fold along fold lines 124 to lock the legs 118 in their extended positions. The cap panel 110 may thus be displayed on a table top or a fireplace mantle or the like of the loved one of the deceased as a memorial to the deceased and keepsake for the loved one.

Figure 6:
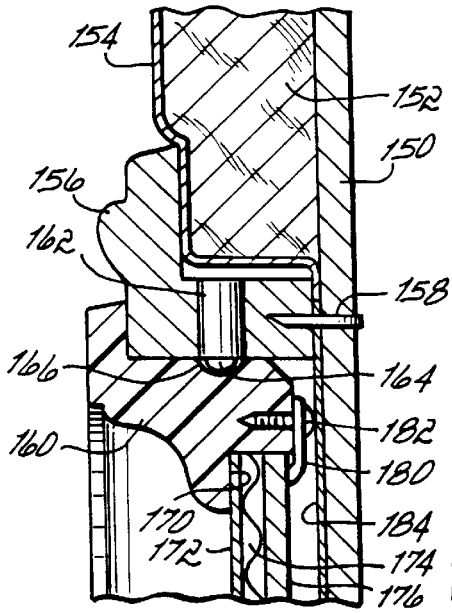
FIG. 6 is a view similar to that of FIG. 5 but of the preferred construction of the invention of FIG. 5.

Referring now to FIG. 6, there is illustrated a preferred construction of the invention illustrated in FIG. 5. In FIG. 6, a cardboard cap panel 150 has mounted thereon one inch thick polyester fill 152 which is covered with decorative fabric 154. The one inch polyester fill 152 includes the oval opening as described above. An outer oval decorative frame 156 is secured to the cardboard cap panel 150 with staples 158. An inner oval decorative frame 160 is removably secured to the outer oval frame 156 by way of a spring loaded ball catch 162 including a ball 164 which is spring biased into a recess 166 in the outer frame 160. Spring loaded ball catches 162 may be of the type available from Woodworkers Supply of Casper, Wyo. as part number 866–840 or 866–854. Frames 156 and 160 may be fabricated of wood, urethane foam or any other suitable material. The outer frame 160 includes a recess 170 therein which accepts, in juxtaposition, a memory plaque or memory board 172, a cardboard filler panel 174 and an easel 176 including legs of the type described above and illustrated in FIG. 4. The memory plaque/board 172, cardboard filler 174 and easel 176 are removably retained in the recess 170 in the frame 160 via a plurality of clips 180 secured with small screws or nails 182. Clips 180 may be of the type available from Woodworkers Supply of Casper, Wyo. as part number 882–560. The cardboard cap panel 150 includes an outer frame backer 184 which is visible upon removal of the frame 160 from the frame 156.

Those skilled in the art will readily recognize numerous adaptations and modifications which can be made to the present invention which will result in an improved casket cap dish assembly, yet all of which will fall within the spirit and scope of the present invention as defined in the following claims. For example, a casket could be supplied with several, e.g., three different double-sided lithographs from which a funeral director could choose and place in the cap panel frame to allow the funeral director to have six casket styles for the price of one. In addition, the keepsake version of the cap panel could be fabricated of an engraveable metal plate, e.g., a 20 gauge stainless steel plate which has been painted and/or brushed, and engraved with, e.g., the initials and birth and death dates of the deceased. Still further, the memory plaque/board could be in the form of a photo collage memorializing the deceased with photos of the deceased with, e.g., family members. Accordingly, the invention is to be limited only by the scope of the following claims and their equivalents.

What is claimed is:

1. A method of memorializing a deceased comprising:

providing a casket having a shell, a cap closeable upon the shell and a cap panel removably installed in the cap, the cap panel being adapted to serve as a memorial to the deceased;

positioning the deceased in the casket;

removing the cap panel from the cap; and presenting the cap panel to a loved one of the deceased as the memorial to the deceased.

2. The method of claim 1 wherein the cap has a dish mounted therein and the cap panel is removably installed in the dish.

3. The method of claim 2 wherein the cap panel is mounted within a frame.

4. The method of claim 2 further including a first frame mounted around an opening of the dish and a second frame in which the cap panel is mounted, the cap panel and second frame being removably installable in the first frame as a unit.

5. The method of claim 1 further including personalizing the cap panel to the deceased.

* * * * *